United States Patent [19]

Münker

[11] 4,137,700

[45] Feb. 6, 1979

[54] BROKEN YARN TRANSFER MECHANISMS FOR TEXTILE YARN PROCESSING MACHINES

[75] Inventor: Gert Münker, Krefeld, Germany

[73] Assignee: Palitex Project Company GmbH, Fed. Rep. of Germany

[21] Appl. No.: 911,272

[22] Filed: May 31, 1978

[30] Foreign Application Priority Data

Jun. 10, 1977 [DE] Fed. Rep. of Germany ..... 2726229

[51] Int. Cl.[2] ..... D01H 15/00; B65H 54/22

[52] U.S. Cl. ..... 57/261; 57/305; 57/58.7; 242/35.5 R; 242/35.6 R; 242/35.6 E; 57/279

[58] Field of Search ..... 57/34 R, 1 R, 34.5, 57/58.49, 58.7, 58.83, 58.86, 106; 242/35.5 R, 35.6 R, 35.6 E, 18 DD

[56] References Cited

U.S. PATENT DOCUMENTS

| | | | |
|---|---|---|---|
| 2,208,930 | 7/1940 | Kahlisch | 242/35.6 R |
| 2,238,923 | 4/1941 | Abbott | 242/35.6 R |
| 3,478,504 | 11/1969 | Nimtz et al. | 57/34 R |
| 3,546,870 | 12/1970 | Schewe et al. | 57/34 R |
| 3,628,320 | 12/1971 | Harmon | 57/34 R |
| 3,820,315 | 6/1974 | Franzen et al. | 57/58.7 X |
| 3,842,580 | 10/1974 | Franzen | 57/34 R |
| 3,975,893 | 8/1976 | Franzen | 57/34 R |
| 4,047,674 | 9/1977 | Kamp | 242/18 DD |

*Primary Examiner*—John Petrakes
*Attorney, Agent, or Firm*—Bell, Seltzer, Park & Gibson

[57] ABSTRACT

In a textile yarn processing machine, such as a two-for-one twister or the like, there is provided a plurality of yarn processing stations each including a spindle assembly carrying a supply package of yarn to be processed and a take-up assembly for forming a take-up package of yarn after processing. A yarn knotter mechanism is selectively positioned in front of the yarn processing stations in the event of yarn breakage for knotting the ends of the broken yarn extending respectively from the spindle assembly and the take-up assembly. Improved yarn transfer mechanisms are provided for withdrawing the broken end of yarn from the take-up assembly and positioning the yarn in the knotter mechanism for being knotted with the broken end of yarn from the spindle assembly. These mechanisms include an uncoiling roller having a fiber attracting surface for being extended to engage the take-up package of yarn and unwind the broken end of yarn therefrom and wind a predetermined amount of the broken end of yarn onto the uncoiling roller, and a yarn transfer wand for engaging the yarn extending between the uncoiling roller and the take-up package for transferring the yarn by movement thereof while unwinding the yarn from the uncoiling roller to the knotter mechanism.

9 Claims, 4 Drawing Figures

BROKEN YARN TRANSFER MECHANISMS FOR TEXTILE YARN PROCESSING MACHINES

This invention relates to a provision of improved mechanisms for transferring the broken end of yarn from a take-up assembly of a yarn processing station of a textile yarn processing machine, such as a two-for-one twister or the like, and positioning the yarn in a knotter mechanism selectively positioned at the front of the yarn processing station for being knotted with the broken end of yarn from a spindle assembly in the yarn processing station.

BACKGROUND OF THE INVENTION

In textile yarn processing machines, particularly a two-for-one twister, a supply package of yarn is carried by a spindle assembly and the unprocessed yarn is drawn off from the supply package in an upward direction, introduced into the top of a yarn inlet tube and passed down through a yarn passageway through the spindle assembly and through the supply package of yarn and then radially outwardly from the spindle assembly. The yarn is then passed upwardly around the outside of the supply package where it forms a rotating balloon of yarn therearound. The yarn then passes through a thread guide eyelet positioned axially above the yarn entry tube. The yarn is processed by the spindle assembly in a well known manner to form a two-for-one twist therein. From the yarn guide eyelet, the yarn passes upwardly to a processed yarn take-up assembly which includes a cradle mechanism carrying a take-up package of yarn and means for selectively rotating the take-up package for winding of the processed yarn thereon.

In the event of yarn breakage, which normally occurs in the vicinity of the rotating baloon of yarn, one of the broken ends of yarn is normally wound onto the take-up package and is worked into the surface thereof. Continued rotation of the take-up package is stopped either manually or by conventional sensing mechanisms sensing the yarn breakage. Thereafter, in order to remedy this yarn breakage, it is necessary to bring together the broken ends of yarn from the take-up assembly and the spindle assembly, respectively, and knot these ends together.

For aiding in achieving this knotting operation, mechanisms are described in U.S. Pat. No. 3,975,893, issued Aug. 24, 1976, and assigned to the assignee of the present invention, for pneumatically threading a yarn end from the supply package through the spindle assembly so that the yarn end would be accessible from the spindle assembly for receipt by a knotter mechanism.

Also, apparatus is described in U.S. Pat. No. 3,478,504, issued Nov. 18, 1969, and assigned to the assignee of the present invention, which includes a self-propelled service trolley which can be run on rails along the outside of the machine for convenient positioning at a selected yarn processing station when a yarn break occurs. The service trolley carries a yarn transfer mechanism which includes an uncoiling roller for engaging the take-up package of processed yarn in the take-up assembly and rotating this take-up package in a direction opposite to the yarn take-up direction for unwinding the yarn. A suction duct is provided which has a knotting device therein and a mouth on one end for receipt of the broken end of yarn unwound from the take-up package and a mouth at the other end thereof for receiving the broken end of yarn from the spindle assembly, so that both ends of yarn may be carried through the suction duct to the knotting device for knotting the ends together. The suction duct is longitudinally slotted at the side facing the yarn processing station for removal of the yarn therefrom after knotting.

In this prior yarn transfer mechanism, there arises in the zone of the longitudinal slot in the suction duct considerable pressure losses resulting in a reduction in the suction force in the duct unless elaborate or expensive sealing strips are provided or the energy expended for such suction is raised to produce adequate suction to overcome such losses. Accordingly, problems have been presented with the construction and operation of the mechanism of this patent.

Additionally, German patent specification OS No. 22 10 469 and U.S. Pat. No. 3,628,320, disclose mechanisms for transferring yarn from a take-up package. However, these devices do not overcome the problems set forth above with respect to the apparatus of assignee's prior U.S. Pat. No. 3,478,504.

OBJECTS AND SUMMARY OF INVENTION

Accordingly, it is the object of this invention to provide improved mechanisms for transferring the broken end of yarn from a take-up assembly of a yarn processing station of a textile yarn processing machine, such as a two-for-one twister or the like, and positioning the yarn in a knotter mechanism selectively positioned at the front of the yarn processing station for being knotted with the broken end of yarn from a spindle assembly in the yarn processing station, and which overcomes the problems presented with prior mechanisms designed for this purpose.

In accordance with this invention, mechanisms are provided in a textile yarn processing machine, such as a two-for-one twister or the like, as follows.

A plurality of yarn processing stations are mounted in generally side-by-side relationship along the outside of the machine and each include a spindle assembly carrying a hollow supply package of yarn to be processed, and a take-up assembly for taking up the yarn after processing and including a cradle mechanism carrying a take-up package of yarn and means for selectively rotating the take-up package for winding of processed yarn thereon during yarn processing and for being disengaged to stop rotation of the take-up package for doffing or in the event of yarn breakage.

Yarn knotter means are provided for being selectively positioned in front of the yarn processing stations in the event of yarn breakage for knotting of the ends of the broken yarn extending respectively from the spindle assembly and the take-up assembly.

Improved yarn transfer means are provided for withdrawing the broken end of yarn from the take-up assembly and positioning the yarn in the knotter means for being knotted with the broken end of yarn from the spindle assembly.

These improved yarn transfer means comprise an uncoiling roller having a fiber attracting surface for engaging the take-up package of yarn in the cradle mechanism and rotating the take-up package in the opposite direction of its take-up rotation for unwinding the broken end of yarn from the take-up package and winding a predetermined amount of the broken end of yarn onto the uncoiling roller. The uncoiling roller includes selectively operated drive means for rotation of the uncoiling roller when in engagement with the take-up package and selectively operated positioning means for moving the uncoiling roller between a retracted position out of engagement with the take-up package and an extended position in engagement with the take-up package. The yarn transfer means further comprises yarn transfer wand means for engaging the yarn extending between the uncoiling roller and the take-up package after the uncoiling roller has wound a predetermined amount of the broken end of yarn from the take-up package thereon and moved to its retracted position and for transferring the yarn by movement thereof while unwinding the yarn from the uncoiling roller to the knotter means for receipt by the knotter means to perform the knotting operation. The yarn transfer wand means includes means for moving the yarn transfer wand means between the yarn engaging position and the yarn transfer position into the knotter means.

Preferably, a service trolley mechanism is mounted for movement along the outside of the textile yarn processing machine and along the front of each of the yarn processing stations and carries the yarn knotter means and the yarn transfer means for convenient positioning thereof in front of a respective yarn processing station when knotting of broken yarn ends is desired.

BRIEF DESCRIPTION OF THE DRAWINGS

Some of the objects, advantages and a general description of the invention having been given, other more specific objects, advantages and a specific description of a preferred embodiment of the invention will be given, as the description proceeds, when taken in conjunction with the accompanying drawings, in which.

DESCRIPTION OF PREFERRED EMBODIMENT

While the drawings and specific description to follow will be related to a two-for-one twister textile yarn processing machine, which is the preferred textile yarn processing machine for use with the improved broken yarn transfer mechanisms of this invention, it is to be understood that these improved broken yarn transfer mechanisms could be utilized with other textile yarn processing machines.

Figure 1:
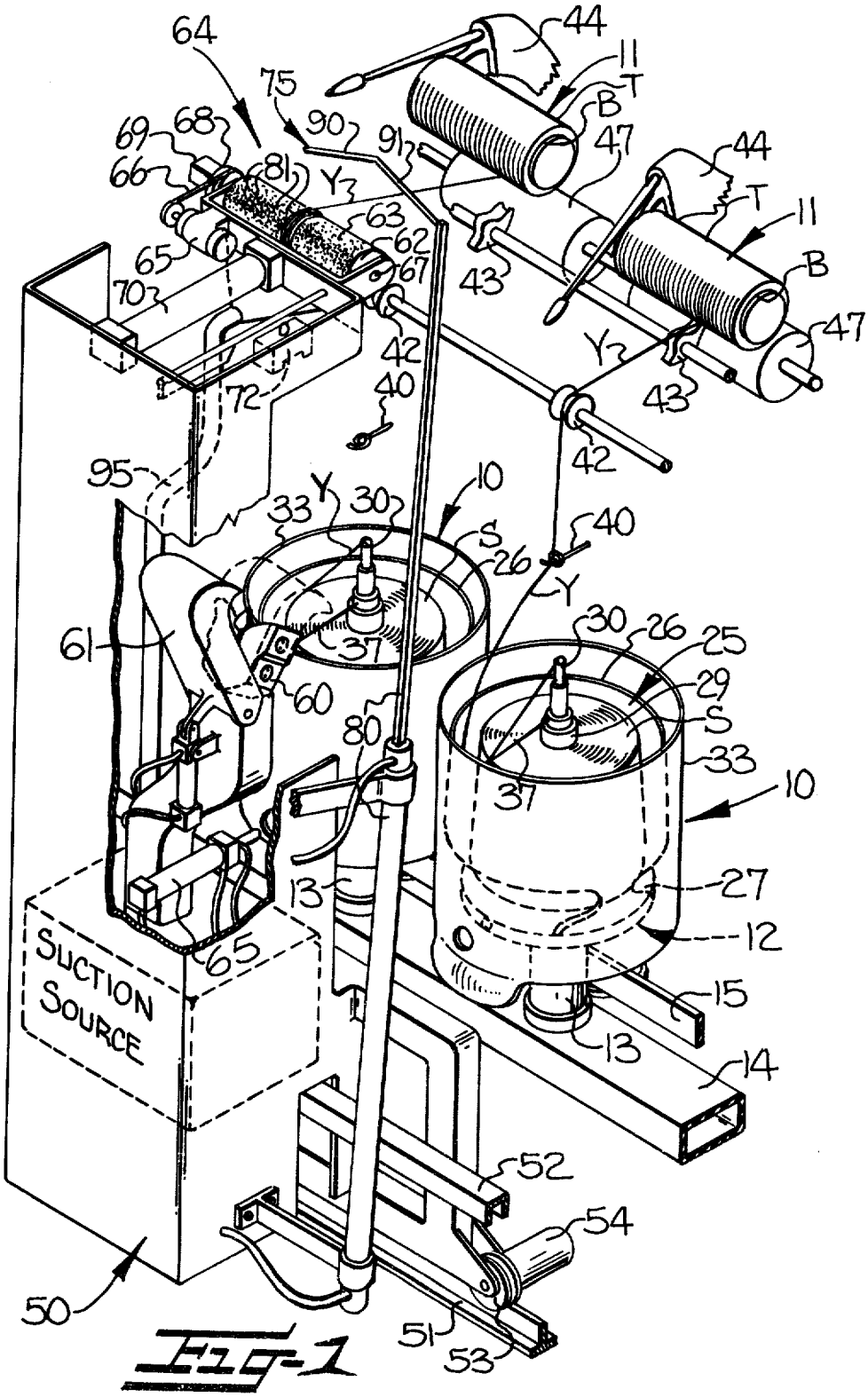
FIG. 1 is a schematic, perspective view of two yarn processing stations of a two-for-one twister textile yarn processing machine with the improved mechanisms of this invention selectively positioned in front of one of the yarn processing stations in which a break has occurred in the yarn being processed.

Referring now to the drawings there is illustrated in FIG. 1 a schematic perspective view of two yarn processing stations of a two-for-one twister textile yarn processing machine each of which includes a spindle assembly 10 and a take-up assembly 11 positioned axially above the spindle assembly 10. It is to be understood that a plurality of these yarn processing stations including a spindle assembly 10 and a take-up assembly 11 are provided in a two-for-one twister textile yarn processing machine in side-by-side relationship in two rows along the outside of the machine. A full illustration and description of the entire two-for-one twister is not given herein and is not believed to be necessary for an understanding of the present invention, the operation and complete structure of such two-for-one twisters are well understood to those with ordinary skill in the art.

Each of the spindle assemblies 10 includes a rotatably driven rotor mechanism, generally indicated at 12, which includes a whorl portion 13 suitably rotatably mounted on a portion of the twister frame 14 and rotated by a continuous tangential drive belt 15 in a manner well understood by those with ordinary skill in the art. The rotor mechanism 12 further includes a horizontally-extending reserve disc device 16 secured to the whorl 13 for rotation therewith and a generally vertically-extending hollow axle device (not shown) which rotates with the reserve disc 16 and extends upwardly within a supply package S of yarn Y. The reserve disc 16 and hollow axle device define therewithin a generally L-shaped yarn passageway (not shown) extending vertically through the hollow axle device and a portion of the reserve disc 16 and generally horizontally and radially out of the reserve disc 16 in a well known manner.

The spindle assembly 10 further includes a stationary carrier mechanism, generally indicated at 25, for supporting and carrying the hollow supply package S of yarn Y and which is rotatably mounted on rotor relative mechanism 12, so that rotor mechanism 12 may rotate relative thereto. The carrier mechanism 25 comprises a basket device 26 which surrounds the supply package S of yarn Y, a circular bottom portion 27 for supporting the hollow supply yarn package S and a hollow hub portion (not shown) including a hollow yarn package carrier member 29 extending into the hollow yarn supply package S and which may further carry a hollow yarn entry tube 30 at the upper end thereof. The hollow axle device of the rotor mechanism 12 extends into the hollow hub portion of the carrier member 25 and the carrier mechanism 25 is rotatably mounted on the rotor mechanism 12 by means of bearings (not shown), so that the rotor mechanism 12 may rotate relative to the stationary carrier mechanism 25 which is held stationary by any suitable means, such as magnetic means (not shown).

The carrier mechanism 25 including the yarn entry tube 30 and carrier member 29 along with the hub portion thereof define a generally vertically-extending yarn passageway (not shown) which is disposed in axial alignment with the yarn passageway through the rotor mechanism 12 for providing a continuous elongate yarn passageway passing downwardly through the top of the carrier mechanism 25, along the axis of the spindle assembly 10 and radially outwardly through the yarn reserve disc 16 of the rotor mechanism 12.

The spindle assembly 10 further includes a stationary balloon limitor device 33 surrounding the basket device 26 of the carrier mechanism 25 and providing a space therebetween for the passage of yarn Y. There is further provided a pigtail flyer mechanism 37 rotatably mounted on the carrier member 29.

The take-up assembly 11 of each yarn processing station includes a yarn guide eyelet 40, preferably of a conventional pigtail shape, positioned above and in axial alignment with the yarn entry tube 30 and the vertically-extending yarn passageway through the spindle assembly 10. The take-up assembly 11 also includes a pretake-up roll 42 and a yarn traversing mechanism 43. There is further provided a yarn take-up or package roll device which includes a cradle mechanism 44 which carries a take-up bobbin B upon which the yarn Y is wound after being processed by the spindle assembly 10 for forming a take-up package T of processed yarn Y. The take-up bobbin B is rotated by driven friction drive roll 47 contacting the outside surface of the processed yarn Y being wound on the bobbin B in a well known manner.

With the above-described mechanisms of the spindle assembly 10 and take-up assembly 11 of a yarn processing station in a two-for-one twister, the yarn Y is withdrawn from the supply package S, passes through the pigtail flyer mechanism 37, through the yarn entry tube 30 and the yarn passageway therethrough and through the spindle assembly 10 to emerge radially outwardly of the rotating rotor mechanism 12 and out of the reserve disc 16. The yarn Y then passes upwardly through the space between the basket device 26 and the balloon limitor 33 to form a rotating balloon of yarn Y as the rotor mechanism 12 is rotated. The yarn Y then passes through yarn guide eyelet 40 which limits the upper end of the rotating balloon of yarn, over pretake-up roll 42 and is traversed by traversing mechanism 43 onto the bobbin B carried by the cradle mechanism 44 of the take-up package roll device to complete its travel through the respective spindle assembly 10 and take-up assembly 11 of a yarn processing station. Further details of the construction and operation of the spindle assembly 10 and take-up assembly 11 are well known to those with ordinary skill in the art and are not needed for an understanding of the present invention. As is well understood by those with ordinary skill in the art, a two-for-one twist is inserted in the yarn during the above-noted path of travel.

The two-for-one twister textile yarn processing machine may further include a service trolley mechanism 50 which is suitably mounted on rails 51, 52 by wheels or rollers 53 for movement along each side of the two-for-one twister textile yarn processing machine and along the front of each of the yarn processing stations for selective positioning in the front of a yarn processing station and respective spindle and take-up assemblies 10, 11. The service trolley mechanism 50 may be driven by a suitable drive, such as motor means 54, and may be selectively positioned at a desired yarn processing station automatically by suitable sensing and control means sensing a break in yarn Y (not shown) in a well known manner.

Figure 2:
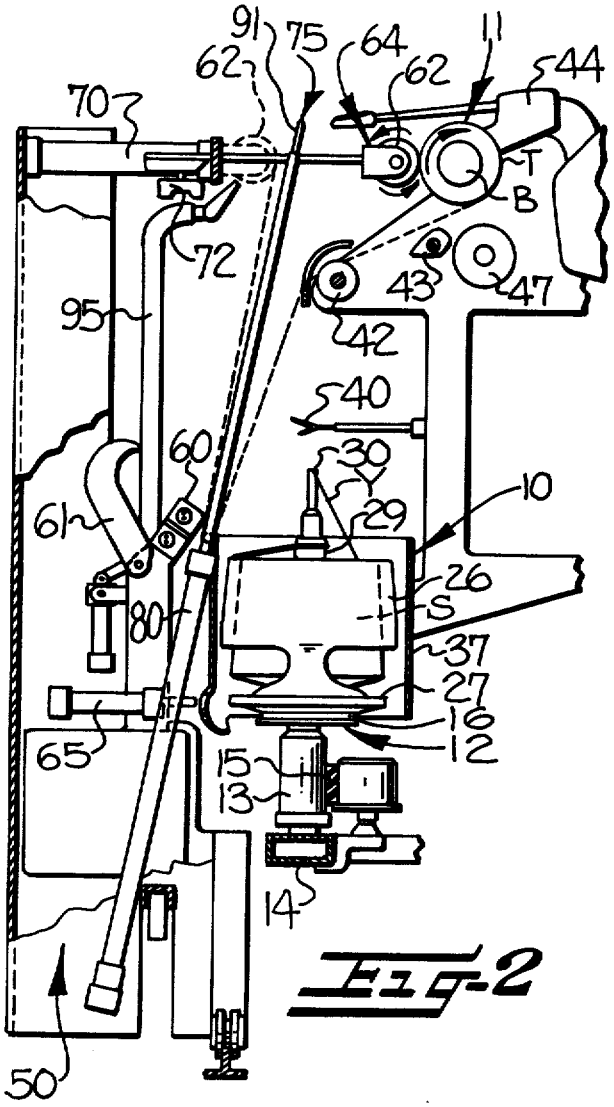
FIG. 2 is a schematic, side elevational view, partly in section, through the yarn processing station of FIG. 1 in front of which the improved mechanisms of this invention have been positioned.

The service trolley mechanism 50 preferably carries a yarn knotter mechanism 60 for knotting together the broken ends of yarn Y extending respectively from the spindle assembly 10 and the take-up assembly 11 when a break in the yarn occurs, which normally occurs in the vicinity of the rotating balloon of yarn Y, described above. This knotter mechanism 60 may be of any suitable conventional construction, such as described in prior U.S. Pat. No. 3,842,580, issued Oct. 22, 1974, and assigned to the assignee of the present invention. As illustrated in this patent, the knotter mechanism 60 includes a suction hood 61 for receiving a broken end of yarn Y emerging from the spindle assembly 10 of the two-for-one twister, as the broken end of yarn Y is threaded through the spindle assembly 10, such as by previously developed pneumatic threading mechanisms 65 which form the subject of U.S. Pat. No. 3,975,893, issued Aug. 24, 1976 and assigned to the assignee of the present invention. The knotter mechanism 60 and spindle assembly pneumatic threading mechanism 65 may both be carried by the service trolley mechanism 50 in accordance with this invention and the suction hood 61 may be movably mounted, as illustrated in FIGS. 1 and 2 herein, for receipt in the knotter mechanism 60 of the broken end of yarn Y extending from the take-up assembly 11 and transferred thereto by the improved mechanisms of this invention, to be described below.

In accordance with the present invention, improved yarn transfer mechanisms, broadly indicated at 64 are preferably carried by the service trolley mechanism 50 for being selectively positioned at the front of a yarn processing station in which a broken yarn Y has occured for withdrawing the broken end of yarn Y from the take-up assembly 11 and positioning the yarn Y in the knotter mechanism 60 for being knotted with the broken end of yarn Y from the spindle assembly 12 received in the knotter mechanism 60 in the manner described above.

These yarn transfer mechanisms 64 comprise an uncoiling roller 62 suitably mounted on an upper overhanging portion of the service trolley 50 and having a fiber attracting surface 63 for engaging the take-up package T of yarn Y in the cradle mechanism 44 of the take-up assembly 11 and rotating the take-up package T in the opposite direction of its take-up rotation for unwinding the broken end of yarn Y from the take-up package T and winding a predetermined amount of the broken end of yarn Y onto the uncoiling roller 62. The uncoiling roller 62 includes selectively operated drive means for rotation of the uncoiling roller 62 when in engagement with the take-up package T. This drive means may comprise a motor 65 which drives a belt and pulley mechanism 66 and rotates shaft 67 carrying the uncoiling roller 63 through a clutch 68 which may be of any suitable type and may include a solenoid 69 for actuation thereof. The uncoiling roller 62 further includes selectively operated positioning means for moving the uncoiling roller 62 between a retracted position (FIG. 1) out of engagement with the take-up package T of yarn Y and an extended position (solid line position of FIG. 2) in engagement with the take-up package T. This selectively operated positioning means may be in the form of a fluid operated piston and cylinder mechanism 70, as shown schematically in the drawings, or any suitable means for moving the uncoiling roller 62 between the above positions. A suitable electrical switch 72 may be provided for actuating the clutch 68 through a suitable circuit (not shown) upon forward movement of the uncoiling roller 62 and for disengaging the clutch 68 upon retraction of the uncoiling roller 62 and for controlling the fluid operated piston and cylinder 70.

The yarn transfer mechanisms 64 of this invention further include a yarn transfer wand device 75 for engaging the yarn Y extending between the uncoiling roller 62 and the take-up package T of yarn Y after the uncoiling roller 62 has wound a predetermined amount of the broken end of yarn Y from the take-up package T thereon and moved to its retracted position and for transferring the yarn Y by movement of the wand mechanism 75 while unwinding the yarn Y from the uncoiling roller 62 after disengagement of the clutch 68 to the knotter mechanism 60 for receipt by the knotter mechanism 60 to perform the knotting operation. The yarn transfer wand mechanisms 75 include means for moving the wand 75 between the yarn engaging position (solid line position of FIG. 2) and the yarn transfer position into the knotter mechanism 60 (dotted line position of FIG. 2) for receipt by the knotter mechanism 60 to perform the knotting operation. As shown in FIGS. 1 and 2, this means for moving the yarn transfer wand mechanism 75 may include a fluid operated piston and cylinder 80 which carries the wand mechanism 75 on one end of the piston for movement between the above-described positions. The piston and cylinder mechanism 80 is suitably mounted on and carried by the service trolley mechanism 50.

Preferably, the fiber attracting surface 63 on the uncoiling roller 62 comprises, as shown in FIG. 1, a raised fiber surface 81, such as a napped or plush surface conventionally formed with a knitted or woven textile fabric, so as to cause the broken end of yarn Y from the take-up package T to adhere thereto during rotation of the take-up package in its reverse direction by the uncoiling roller 62. However, the uncoiling roller 62, as shown in FIG. 4, may have a fiber attracting surface in the form of perforations 82 and the uncoiling roller 62 would be of a hollow cylindrical construction to which a source of suction is connected thereto, as schematically indicated, to cause a suction through the perforations 82.

Figure 3:
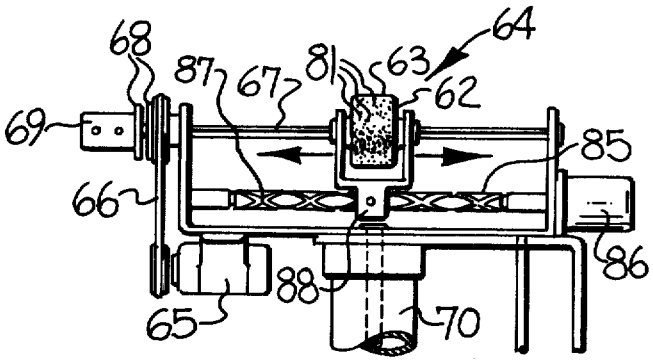
FIG. 3 is a partial, schematic view of an alternative form of uncoiling roller which may be utilized in the mechanisms of this invention.
Figure 4:
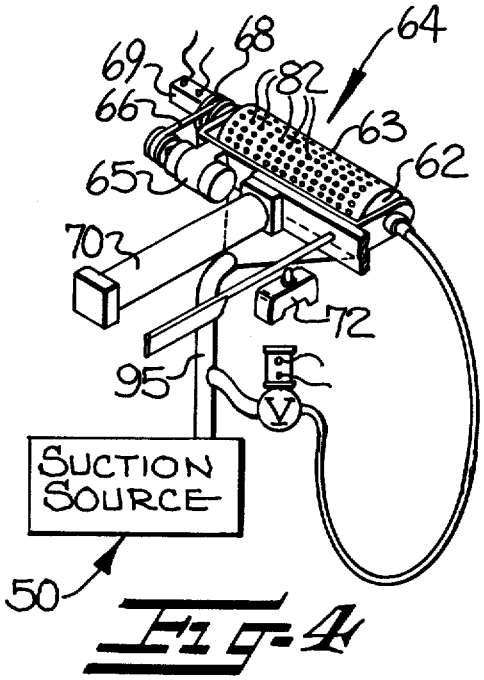
FIG. 4 is a partial, schematic view of a further alternative form of uncoiling roller which may be utilized in the mechanisms of this invention.

The uncoiling roller 62 preferably comprises a length equal to the length of the take-up package T of yarn Y for full engagement along the length thereof to insure receipt of the broken end of yarn Y therefrom regardless of where it is finally located by the yarn traversing mechanism 43 during unwinding thereof (as shown in FIGS. 1 and 4). However, the uncoiling roller 63 may be of a shorter length and/or include means for causing transverse reciprocating movement thereof, as indicated schematically in FIG. 3, so that the uncoiling roller 62 will traverse back and forth along the full length of the take-up package T for receipt of the broken end of yarn Y regardless of where it is ultimately positioned. The mechanism for effecting this transverse reciprocating movement of the uncoiling roller 62 of FIG. 3 may be any suitable mechanism such as shaft 85 driven by motor 86 and having a spiraled keyway 87 therein to which the uncoiling roller 62 is keyed by way of a yoke 88. The uncoiling roller 62 is also keyed to shaft 67 for rotation and is free to move longitudinally thereof.

Preferably, the yarn transfer wand 75 extends essentially parallel to and over the entire length of the uncoiling roller 62 to insure engagement with the yarn extending between the uncoiling roller 62 and the take-up package T. Further, the yarn transfer wand 75 preferably comprises two rod sections 90, 91 which form an obtuse angle with respect to each other and are joined together at substantially the center of the wand 75 to insure proper positioning of the yarn Y in the knotter mechanism 60 by allowing the yarn Y to ride down the rod sections 90 or 91 to the center of the wand 75.

With the above arrangement of yarn transfer mechanisms 64 in accordance with this invention, when a yarn Y has broken at a particular yarn processing station of the two-for-one twister, the service trolley mechanism 50 will be brought into position in front of the yarn processing station, either manually or automatically through suitable sensing and control circuit mechanisms (not shown). Thereafter, the uncoiling roller 62 will be extended by the piston and cylinder mechanism 70 to engage the take-up package T of processed yarn Y which has been lifted either manually or automatically from the friction drive roll 47 and will be rotated in the opposite direction of its take-up rotation by rotation of the uncoiling roller 62 through the drive motor 65 and clutch 68. The fiber attracting surface 63 on the uncoiling roller 62 will cause adherence thereto of the broken end of yarn Y and the winding thereon of a predetermined amount of the broken end of yarn Y from the take-up assembly 11.

The uncoiling roller 62 will then be retracted to its retracted position by the piston and cylinder mechanism 70 and the drive to the uncoiling roller 62 will be shut off and the clutch 68 disengaged. Thereafter, the yarn transfer wand mechanism 75 will engage the yarn Y extending between the uncoiling roller 62 and the take-up package T and transfer the yarn Y downwardly to be received by the knotter mechanism 60 by movement of the wand mechanism 75 by the piston and cylinder device 80 to its lower position and by unwinding of the yarn Y from the uncoiling roller 62 by free rotation of the roller 62 through the disengaged clutch 68. After receipt by the knotter mechanism 60, the wand mechanism 75 will return to its upper position.

The broken end of yarn Y from the spindle assembly 10 will be received by the knotter mechanism 60 by actuation of the pneumatic threading mechanism 65 of assignee's above-described U.S. Pat. No. 3,975,893 which will thread the broken end of yarn Y through the spindle assembly 10 for receipt by the suction hood 61 of the knotter mechanism 60 in the manner described in assignee's above-identified U.S. Pat. No. 3,842,580. These two broken yarn ends will then be knotted together by the knotter mechanism 60 in a well known manner and the yarn processing station may then again be started up for further processing of yarn Y. After knotting, the free ends of yarn Y will be cut by the knotter mechanism in a well known manner and removed by suction. In this regard, a suction removal device 95 may be provided adjacent the uncoiling roller 62 for removing the residual end of yarn Y after knotting and cutting.

The yarn transfer mechanisms 60 of this invention, as well as the spindle assembly pneumatic threading mechanisms 65, knotter mechanism 60 and service trolley mechanism 50 may include a suitable control circuit or other type of control mechanisms (not shown) for effecting automatic operation of these mechanisms; however, such a control does not form a specific part of this invention and will not be described herein.

In the drawings and specification, there has been set forth a preferred embodiment of this invention, and although specific terms are employed, they are used in a generic and descriptive sense only and not for purposes of limitation.

What is claimed is:

1. In a textile yarn processing machine, such as a two-for-one twister or the like, the combination of:

a plurality of yarn processing stations mounted in generally side-by-side relationship along the outside of said machine and each including a spindle assembly carrying a hollow supply package of yarn to be processed, and a take-up assembly for taking up the yarn after processing and including a cradle mechanism carrying a take-up package of yarn and means for selectively rotating the take-up package for winding of processed yarn thereon during yarn processing and for being disengaged to stop rotation of the take-up package for doffing or in the event of yarn breakage;

yarn knotter means for being selectively positioned in front of said yarn processing stations in the event of yarn breakage for knotting of the ends of the broken yarn extending respectively from said spindle assembly and said take-up assembly; and yarn transfer means for withdrawing the broken end of yarn from said take-up assembly and positioning the yarn in said knotter means for being knotted with the broken end of yarn from said spindle assembly, said means comprising an uncoiling roller having a fiber attracting surface for engaging the take-up package of yarn in said cradle mechanism and rotating the take-up package in the opposite direction of its take-up rotation for unwinding of the broken end of yarn from the take-up package and winding a predetermined amount of the broken end of yarn onto the uncoiling roller and including selectively-operated drive means for rotation of said uncoiling roller when in engagement with the take-up package and selectively operated positioning means for moving said uncoiling roller between a retracted position out of engagement with the take-up package and an extended position in engagement with the take-up package, said means further comprising yarn transfer wand means for engaging the yarn extending between said coiling roller and the take-up package after said uncoiling roller has wound a predetermined amount of the broken end of yarn from the take-up package thereon and moved to its retracted position and for transferring the yarn by movement thereof while unwinding the yarn from said uncoiling roller to said knotter means for receipt by said knotter means to perform the knotting operation and including means for moving said yarn transfer wand means between the yarn engaging position and the yarn transfer position into said knotter means.

2. In a textile yarn processing machine, such as a two-for-one twister or the like, the combination of:

a plurality of yarn processing stations mounted in generally side-by-side relationship along the outside of said machine and each including a spindle assembly carrying a hollow supply package of yarn to be processed, and a take-up assembly for taking up the yarn after processing and including a cradle mechanism carrying a take-up package of yarn and means for selectively rotating the take-up package for winding of processed yarn thereon during yarn processing and for being disengaged to stop rotation of the take-up package for doffing or in the event of yarn breakage;

yarn knotter means for being selectively positioned in front of said yarn processing stations in the event of yarn breakage for knotting of the ends of the broken yarn extending respectively from said spindle assembly annd said take-up assembly;

yarn transfer means for withdrawing the broken end of yarn from said take-up assembly and positioning the yarn in said knotter means for being knotted with the broken end of yarn from said spindle assembly, said means comprising an uncoiling roller having a fiber attracting surface for engaging the take-up package of yarn in said cradle mechanism and rotating the take-up package in the opposite direction of its take-up rotation for unwinding of the broken end of yarn from the take-up package and winding a predetermined amount of the broken end of yarn onto the uncoiling roller and including selectively operated drive means for rotation of said uncoiling roller when in engagement with the take-up package and selectively operated positioning means for moving said uncoiling roller between a retracted position out of engagement with the take-up package and an extended position in engagement with the take-up package, said means further comprising yarn transfer wand means for engaging the yarn extending between said uncoiling roller annd the take-up package after said uncoiling roller has wound a predetermined amount of the broken end of yarn from the take-up package thereon and moved to its retracted position and for transferring the yarn by movement thereof while unwinding the yarn from said uncoiling roller to said knotter means for receipt by said knotter means to perform the knotting operation and including means for moving said transfer wand means between the yarn engaging position and the yarn transfer position into said knotter means; and a service trolley mechanism mounted for movement along the outside of said textile yarn processing machine and along the front of each of said yarn processing stations and carrying said yarn knotter means and said yarn transfer means for convenient positioning thereof in front of a respective yarn processing station when knotting of broken yarn ends is desired.

3. In a textile yarn processing machine, as set forth in claims 1 or 2, in which said fiber attracting surface on said uncoiling roller comprises a raised fiber surface, such as a napped or plush textile fabric surface.

4. In a textile yarn processing machine, as set forth in claims 1 or 2, in which said selectively operated drive means for rotation of said uncoiling roller includes clutch means for being engaged when said drive means is rotating said uncoiling roller during engagement thereof with the take-up package of yarn and is disengaged when said uncoiling roller is in the retracted position so that the yarn may be unwound therefrom by said yarn transfer wand means during movement thereof to said knotter means.

5. In a textile yarn processing machine, as set forth in claims 1 or 2, in which said uncoiling roller comprises a length equal to the length of the take-up package of yarn for full engagement therewith to insure receipt of the broken end of yarn therefrom during unwinding.

6. In a textile yarn processing machine, as set forth in claims 1 or 2, in which said yarn transfer wand means comprises wand means extending essentially parallel to and over the entire length of said uncoiling roller to insure engagement with the yarn extending between said uncoiling roller and the take-up package.

7. In a textile yarn processing machine, as set forth in claims 1 or 2, in which said yarn transfer wand means comprises two rod sections forming an obtuse angle with each other and joined together at substantially the center of said wand means to insure proper transfer of the yarn into said knotter means.

8. In a textile yarn processing machine, as set forth in claims 1 or 2, in which said uncoiling roller further includes means for reciprocating said roller back and forth in the direction of its axis to insure receipt of the broken end of yarn from the take-up package.

9. In a textile yarn processing machine, as set forth in claims 1 or 2, in which said uncoiling roller comprises a hollow cylinder having perforations in the circumferential surface thereon and a vacuum source connected thereto for creating a vacuum at said perforations for forming said fiber attracting surface.

* * * * *